US007753125B1

(12) United States Patent
Penisson

(10) Patent No.: US 7,753,125 B1
(45) Date of Patent: Jul. 13, 2010

(54) ROTATING, JET-BIASED WELLBORE CLEANING TOOL

(76) Inventor: Dennis J. Penisson, 2265 Highway 182, Raceland, LA (US) 70394

( * ) Notice: Subject to any disclaimer, the term of this patent is extended or adjusted under 35 U.S.C. 154(b) by 22 days.

(21) Appl. No.: 12/048,535

(22) Filed: Mar. 14, 2008

Related U.S. Application Data

(60) Provisional application No. 60/895,097, filed on Mar. 15, 2007.

(51) Int. Cl.
*E21B 37/00* (2006.01)

(52) U.S. Cl. ..... 166/312; 166/173

(58) Field of Classification Search ..... 166/173, 166/170, 311, 312, 222, 223; 15/104.05, 15/104.09
See application file for complete search history.

(56) References Cited

U.S. PATENT DOCUMENTS 3,310,113 A * 3/1967 Maness ..... 166/173
7,017,593 B2 * 3/2006 Honda ..... 134/22.11

* cited by examiner

*Primary Examiner*—Jennifer H Gay
*Assistant Examiner*—Kipp C Wallace
(74) *Attorney, Agent, or Firm*—Carver, Darden, Koretzky, Tessier, Finn, Blossman & Areaux, LLC; Raymond G. Areaux; Lisa Velez

(57) ABSTRACT

A wellbore cleaning tool having a plurality of fluid jets arranged on one side of a tool body and brushes or other implements for applying an abrasion force arranged on a second side of the tool body. In operation, the fluid jets, when turned on, bias the tool body and the supported brushes toward the casing wall with a resilient jet-biasing effect. Furthermore, the tool body is intended to be rotated. Thereby, the resilient jet-biasing effect rotates accordingly so that the brushes remain biased toward the casing wall during rotation.

32 Claims, 4 Drawing Sheets

ROTATING, JET-BIASED WELLBORE CLEANING TOOL

CO-PENDING APPLICATION

This invention claims priority benefit of provisional application Ser. No. 60/895,097 filed on Mar. 15, 2007 and incorporated herein by reference as if set forth in full below.

BACKGROUND OF THE INVENTION

I. Field of the Invention

The present invention relates to wellbore cleaning tools, and more particularly, to a jet-biased wellbore cleaning tool which biases downhole the brushes and/or scrapers of the tool toward the casing wall with fluid jets.

II. General Background

Cleaning tools using brushes and scrapers are well known. While casing sizes are standard, during brushing, the bristles of the brushes bend and distort, as the tool engages debris adhering to the casing. Hence, during the cleaning action, the ability of the brush or scraper to apply a force of abrasion diminishes over time. Thus, the tool must be removed from the wellbore and the brushes or scrapers removed. Then, the tool is reinserted downhole which completes a roundtrip.

Removing the cleaning tool to replace brushes or scrapers is time consuming and costs the oil field industry revenue. Thus, limiting the downhole roundtrips by the cleaning tool and maintaining the tools ability to clean is highly desirable. Sometimes, different sized cleaning tools are needed as the diameter of the wellbore varies.

Known cleaning tools do not control the abrasion force applied to the debris on the casing wall or the casing wall. Instead, a brush or scraper when engaging debris causes the cleaning tool to reciprocate in the casing. Thus, the total force of abrasion can be reduced by the amount the cleaning tool moves away from the casing wall or debris as debris is encountered.

In view of the foregoing, there is a continuing need for a cleaning tool with casing abrasion cleaning members and fluid jets wherein the fluid jets are arranged to provide a force of fluid to carry debris to the top of the wellhead and, simultaneously and automatically, bias the casing abrasion cleaning members in the direction of the casing wall.

There is a continuing need for a cleaning tool which can rapidly remove and replace the casing abrasion cleaning members during operations.

There is a continuing need for a cleaning tool which is constructed and arranged to automatically force the casing abrasion cleaning members to make direct contact with debris on the casing wall or the casing wall and minimize reciprocation by the cleaning tool.

There is a need for a cleaning tool which enhances the force of abrasion applied to the debris on the casing wall and extends the force of abrasion on the casing wall for longer periods of time than existing cleaning tools.

SUMMARY OF THE INVENTION

In view of the aforementioned problems, it is an object of the present invention to provide a jet-biased wellbore cleaning tool which automatically biases downhole brushes and/or scrapers of the tool toward the casing wall.

It is a further object of the present invention to provide a jet-biased wellbore cleaning tool with casing abrasion cleaning members and fluid jets wherein the fluid jets are arranged to provide a force of fluid to carry debris to the top of the wellhead and, simultaneously and automatically, bias the casing abrasion cleaning members in the direction of the casing wall.

A still further object of the present invention is to provide a jet-biased wellbore cleaning tool which can rapidly remove and replace the casing abrasion cleaning members during operations.

A still further object of the present invention is to provide a jet-biased wellbore cleaning tool which is constructed and arranged to automatically force the casing abrasion cleaning members to make direct contact with debris on the casing wall or the casing wall and minimize reciprocation by the cleaning tool.

A still further object of the present invention is to provide a jet-biased wellbore cleaning tool which enhances the force of abrasion applied to the debris on the casing wall and extends the force of abrasion on the cleaning wall for longer periods of time than existing cleaning tools.

A still further object of the present invention is to provide a jet-biased wellbore cleaning tool which can turn off the biasing force such as when the tool is being moved between sections of the wellbore with different diameters or as otherwise needed.

In view of the above objects, the present invention contemplates a jet-biased wellbore cleaning tool having a tool body assembly with a first side and a second side. The first side has attached thereto the plurality of casing abrasion cleaning members which radiate from the first side. The second side has attached thereto the fluid jets. The first side and the second side are opposite sides or diametrically opposing.

In view of the above objects, the present invention contemplates a jet-biased wellbore cleaning tool with fluid jets which provide a resilient jet-biasing effect on the tool body assembly to force the plurality of casing abrasion cleaning members toward the casing wall as the tool body is rotated.

The resilient jet-biasing effect automatically biases the plurality of casing abrasion cleaning members toward the casing wall of varying diameters.

Furthermore, the resilient jet-biasing effect is adapted to be selectively turned on and off downhole in the wellbore.

The present invention further contemplates a method of cleaning a wellbore casing wall comprising the steps of: applying a force of abrasion to the casing wall by a cleaning tool; and, jetting fluid from the cleaning tool in the wellbore casing wall to create fluid jets to carry debris uphole and simultaneously applying a resilient jet-biasing force via the fluid jets to bias the force of abrasion to one side of the casing wall.

The method also includes the steps of: rotating the cleaning tool and the force of abrasion; and, simultaneously rotating the resilient jet-biasing force and the fluid jets.

The method further comprising the method steps of: turning off the jet-biasing force downhole; and simultaneously with the turning off step, orienting cleaning tool in a center of the casing wall.

An advantage of the present invention is that the resilient properties of the resilient jet-biasing effect created by the fluid jets allows the cleaning tool to automatically adapt to varying diameters of the casing wall without the need to change the size of the brushes or scrapers.

An additional advantage of the present invention is that the resilient properties of the fluid jet allows the resilient jet-biasing effect to act in a manner similar to a spring with added control of the force exerted by the resilient jet-biasing effect.

The above and other objects and features of the present invention will become apparent from the drawings, the description given herein, and the appended claims For a further understanding of the nature and objects of the present invention, reference should be had to the following description taken in conjunction with the accompanying drawings in which like parts are given like reference numerals and, wherein:

DETAILED DESCRIPTION OF THE INVENTION

Figure 1:
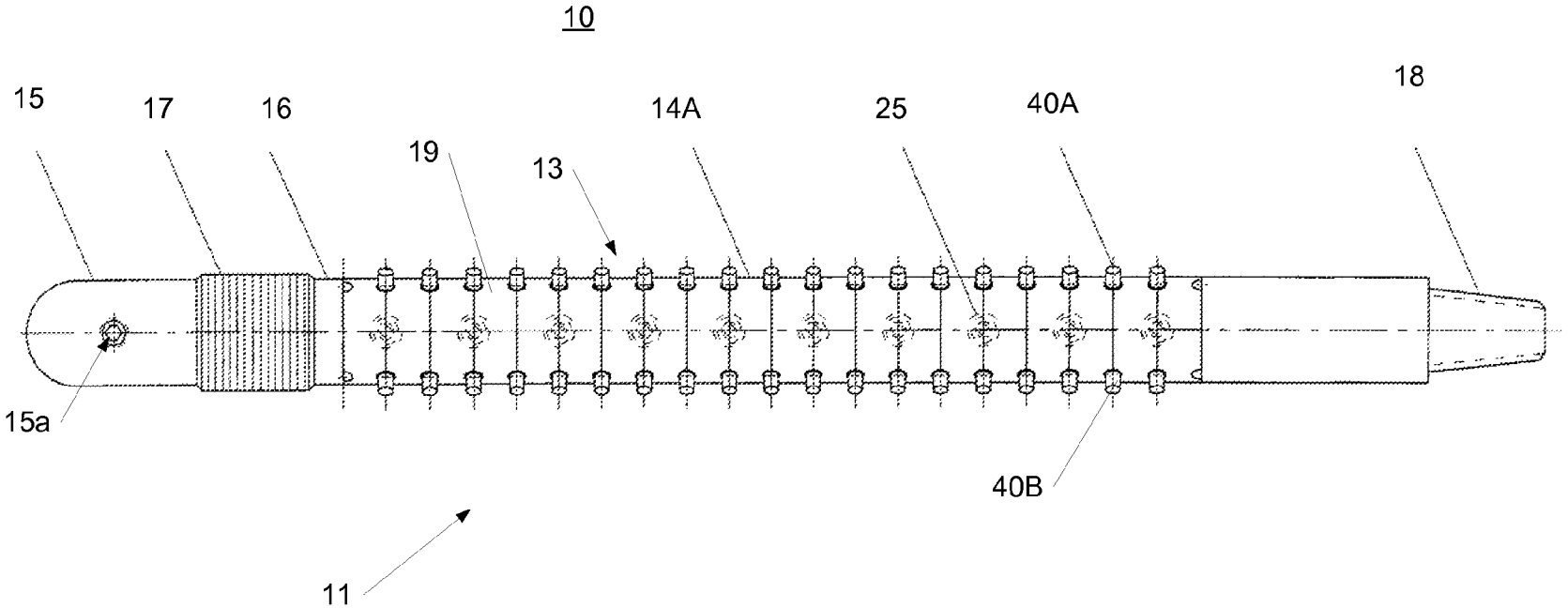
FIG. 1 illustrates an elevational view of a jet-biased wellbore cleaning tool in accordance with the present invention.
Figures 2, 3, 4:
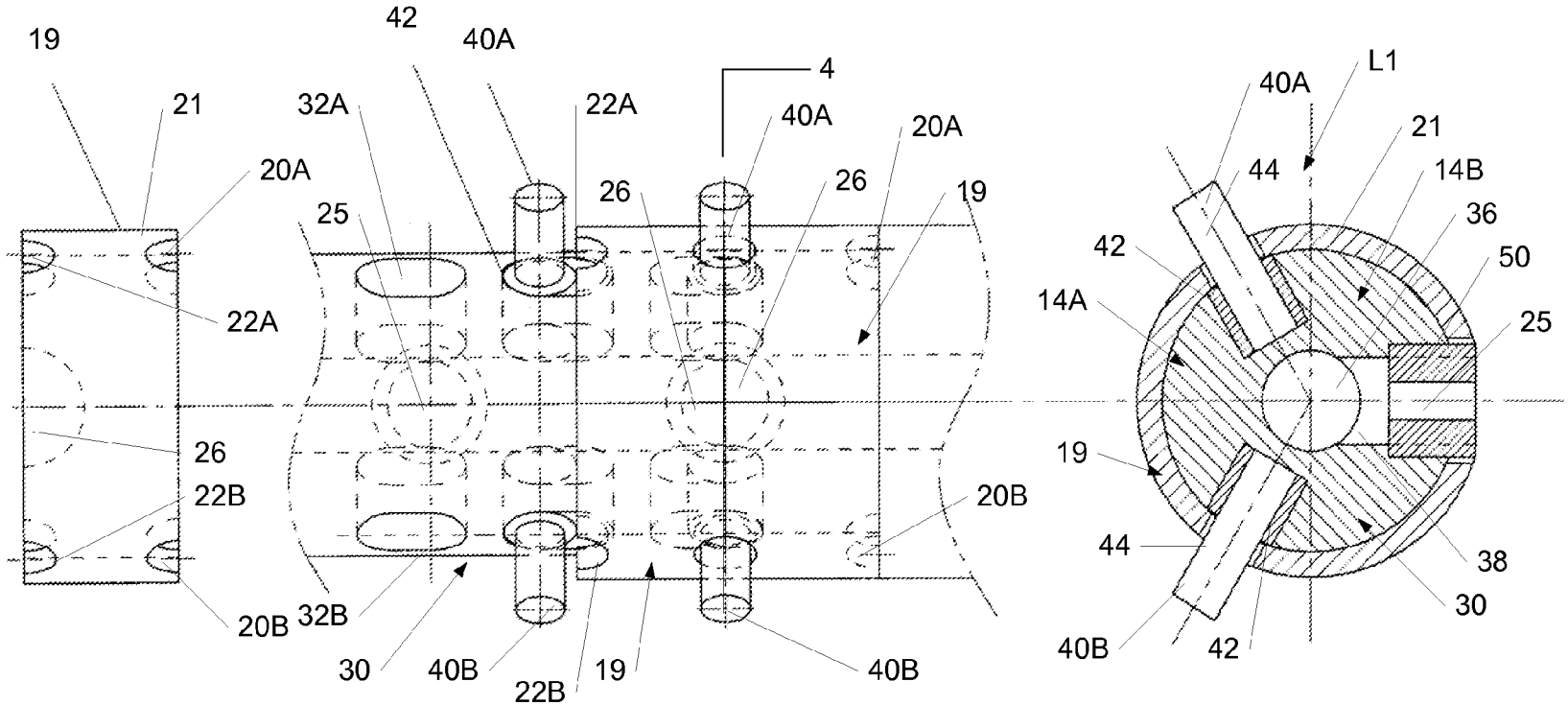
FIG. 2 illustrates a clamping sleeve of the tool in FIG. 1.
FIG. 3 illustrates a partial view of a set of clamping sleeves concentric with a tool body base in accordance with the present invention.
FIG. 4 illustrates a cross sectional view along the plane 4-4 of FIG. 3.
Figure 6:
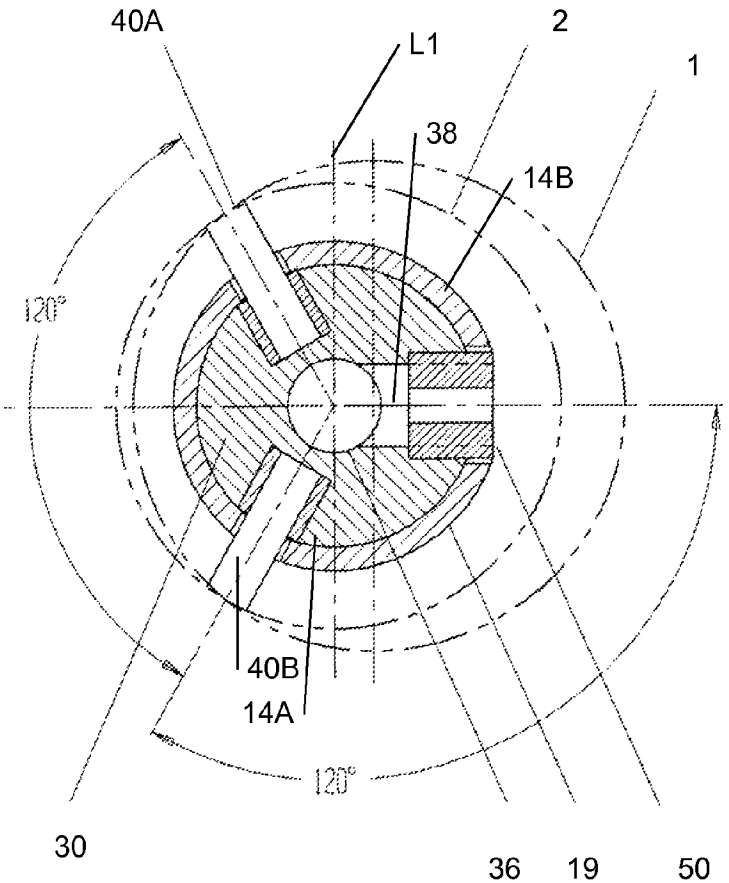
FIG. 6 illustrates a cross sectional view along the plane 4-4 of FIG. 3 in a wellbore demonstrating the jet-biasing effect.
Figure 5:
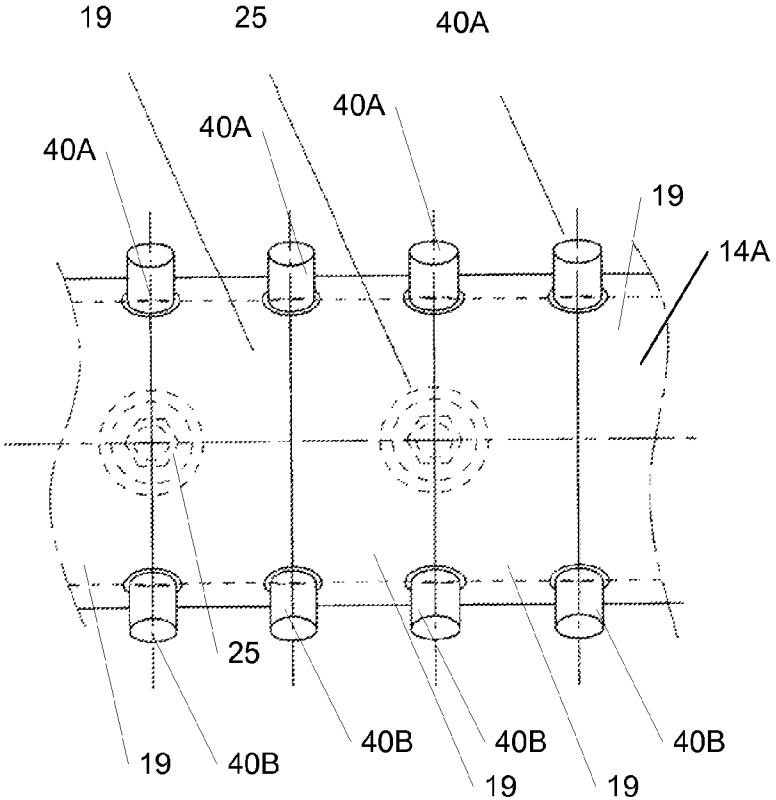
FIG. 5 illustrates partial view of the tool body assembly in accordance with the present invention.

Referring now to the drawings, and particularly to FIG. 1, a jet-biased wellbore cleaning tool of the present invention is generally referenced by the numeral 10. The jet-biased wellbore cleaning tool 10 comprises, in general, a tool body assembly 11 with a plurality of casing abrasion cleaning members 40A and 40B positioned longitudinally along a first circumferential section 14A. The tool 10 further comprises a plurality of fluid jets 25 (shown in phantom) arranged longitudinally along a second circumferential section 14B opposite the first circumferential section 14A of the tool body assembly 11, as best seen in FIGS. 4 and 6. This portion of the tool body assembly 11 is the central body section 13. The term abrasion as defined herein may include scraping, brushing, sweeping, or wiping.

In the exemplary embodiment, the first circumferential section 14A and the second circumferential section 14B are generally ½ (half) portions of the circumference of the tool body assembly 11 divided by the phantom line L1 shown in FIGS. 4 and 6. Thus, the first circumferential section 14A and the second circumferential section 14B form semi-circular longitudinal sections. Nevertheless, the circumference of the tool body assembly 11 may be divided by other fractions.

The tool body assembly 11 further includes a bottom threaded nut end 15, to keep the tool body assembly 11 together. A set screw 15*a* is used to prevent the nut from loosening. A clamping washer 16 is used between the bottom threaded nut end 15 and clamping sleeves 19 of the central body section 13 and an optional plastic guide 17 for moving the tool 10 through changing diameters. At the top end of the central body section 13 of the tool body assembly 11, a threaded connection 18 is attached to connect the tool 10 to a source of fluid and rotation.

The plastic guide 17 can be used as a No-Go to protect nipple seal surfaces and to limit the amount of contact the bristles 44 (FIGS. 7 and 8) would have with the casing wall 1, shown in phantom in FIG. 6. Limiting the bristle's contact would prevent total mashing of the bristles 44 if the fluid jets 25 are too strong. Furthermore, the plastic guides 17 may be placed at one or more locations along the tool 10, such as in the middle and top.

In the exemplary embodiment, the plurality of casing abrasion cleaning members 40A and 40B are arranged in pairs along the first circumferential section 14A. Each pair of casing abrasion cleaning members 40A and 40B forms an obtuse angle (e.g. approximately) 120° therebetween, as best seen in FIG. 6, with reference to the center of members 40A and 40B. The center of the jet 25 is essentially positioned at the midpoint of the second circumferential section 14B which corresponds to approximately 120° from the center of casing abrasion cleaning members 40A and 40B.

The exemplary embodiment illustrates two casing abrasion cleaning members 40A and 40B. Nevertheless, the first circumferential section 14A may be constructed to accommodate two or more casing abrasion cleaning members 40A and 40B. Thus, the angle between the casing abrasion cleaning members would be less than 120° and may be angularly displaced by an acute angle in lieu of an obtuse angle. Moreover, the 120° may be varied and is limited to the size of the first circumferential section 14A. In generally, the distance between a pair of casing abrasion cleaning members 40A and 40B is generally less than 180° such as when the first and second circumferential sections 14A and 14B are each 180°.

Figure 7:
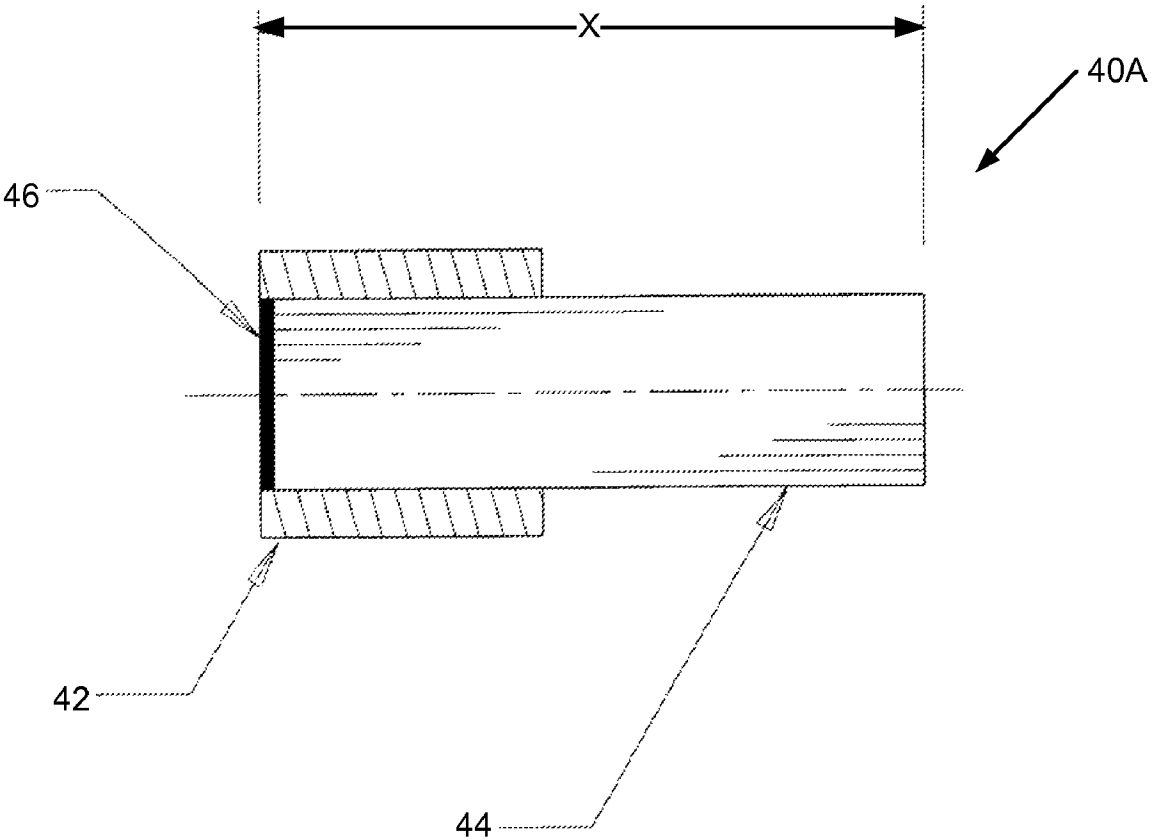
FIG. 7 illustrates a cross-sectional side view of the casing abrasion member in accordance with the present invention; and, FIG. 8 illustrates a top end view of the casing abrasion member of FIG. 7.

In the exemplary embodiment, the casing abrasion cleaning members 40A and 40B are brushes. Nevertheless, other devices or implements, such as without limitation scrapers or blades, which can apply a force of abrasion to the casing wall 1 for cleaning debris may be substituted. For illustrative purposes, the brushes are shown in FIG. 7. Since, each casing abrasion cleaning member is essentially identical, only one such casing abrasion cleaning member 40A will be described in detail.

Figure 8:
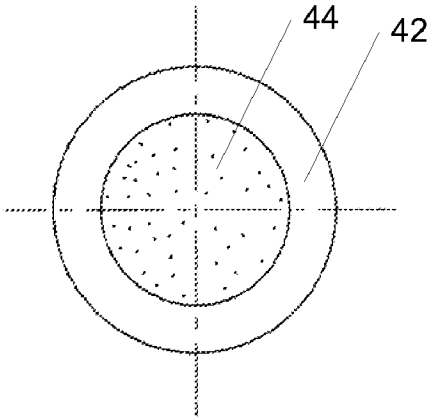

With reference to both FIGS. 7 and 8, the casing abrasion cleaning member 40A includes a plurality of bristles 44, denoted by the black dots in FIG. 8, having a length X. The bristles 44 are a bundle of (metal) wire bound together by wrapping ring 42. The length X should be sufficient to allow the bristles 44 to radiate from the first circumferential section 14A (beyond the exterior surface of clamping sleeve 19). The bottom end of the bundle of wire is welded to form a welded brush bottom 46. The welded brush bottom 46 is essentially flush with a bottom rim of the wrapping ring or base 42. The length X can vary to best fit certain ranges of pipe diameters. The preferred length X keeps the tool 10 as close to the center of the wellbore as possible.

The bristles 44 may alternately be made of fiber or other rigid or durable material. The stiffness and shape may vary depending on application. The stiffness of the bristles 44 may be suitable for abrasion. Nevertheless, the bristles 44 may be constructed and arranged for sweeping or wiping.

Referring now to FIGS. 3-4 and 6, the central body section 13 of the tool body assembly 11 includes an interior tool body base 30 having a plurality of pairs of seating channels 32A and 32B dimensioned to receive and seat therein the wrapping ring or base 42 of casing abrasion cleaning members 40A and 40B. The center of the interior tool body base 30 has a hollow core 36 to funnel fluid therethrough. The hollow core 36 has a plurality of orifices 38 on the side corresponding to the area of the second circumferential section 14B to jet fluid therethrough.

In the exemplary embodiment, each of the seating channels 32A and 32B are generally elliptically shaped. Nevertheless, shape of the seating channels 32A and 32B will depend on the means of attaching the brushes or other implements to apply the force of abrasion.

With reference also to FIG. 2, a series of clamping sleeves 19 are used to clamp and lock the pairs of casing abrasion cleaning members 40A and 40B in their corresponding seating channels 32A and 32B of the interior tool body base 30. In the exemplary embodiment, each clamping sleeve 19 has a top pair of half (semi-circular) holes 20A and 20B aligned with the seating channels 32A and 32B. Each clamping sleeve 19 has a ring-shaped (bracelet) structure 21 and a bottom pair of half (semi-circular) holes 22A and 22B which aligned with an adjacent set of the seating channels 32A and 32B. Hence, when two adjacent clamping sleeves 19 are juxtaposed, the clamping sleeves 19 clamp and lock one pair of the casing abrasion cleaning members 40A and 40B in their seats, as best seen in FIG. 3. However, the two adjacent clamping sleeves 19 also provide the other half (semi-circular) holes 20A and 20B and half (semi-circular) holes 22A and 22B for the adjacent pairs of casing abrasion cleaning members 40A and 40B.

CNC machine tools allow building stacking rings, locating holes and slots with precision. The clamping sleeve 19 described herein is for illustrative purposes. Many other means of attaching the casing abrasion cleaning members 40A and 40B into a tool body assembly 11 known in the art can be used.

In general, the mated half holes 20A and 20B (concaved recesses) of a clamping sleeve 19 mates with the mated half holes 22A and 22B (convex recesses) of an adjacent clamping sleeve 19 to form complete holes, openings or circles which have a circumference which is smaller than the circumference of the wrapping ring or base 42. Thereby, the casing abrasion cleaning members 40A and 40B are locked in their seats. To remove the casing abrasion cleaning members 40A and 40B or add new casing abrasion cleaning members 40A and 40B, the series of clamping sleeves 19 are loosened or separated so that the casing abrasion cleaning members 40A and 40B can be removed from their seating channels 32A and 32B.

The number of seating channels 32A and 32B and the casing abrasion cleaning members 40A and 40B depend on the size of the tool 10 and the application.

Each fluid jet 25 includes a plug 50 secured in an orifice 38. For example, the plug 50 may be threaded and screwed in the orifice 38. Nevertheless, other fastening or attaching means may be substituted. The orifice 38 is in fluid communication with hollow core 36 and has a top diameter (closer to the exterior side) which is larger than the bottom diameter. The reduction in the size of the channel defined by orifice 38 provides a seat for the plug 50. The center of the plug 50 is hollow or drilled to form the fluid jet 25. Interchanging the plug 50 allows the jet size to be varied. Each clamping sleeve 19 has a corresponding half (semi-circular) hole 26 (convex recess). Hence, when two adjacent clamping sleeves 19 are juxtaposed, the two half holes 26 form a complete hole, opening or circle, around the plug 50.

Referring now to FIG. 6, in operation the tool 10 is used to clean wellbore casing wall 1 (shown in phantom) and debris adhering to the casing wall 1 with a force of abrasion. The tool 10 is used as part of a sequence of steps in preparing a well for production. The tool 10 dislodges debris from the casing wall 1 while fluid jetting from the tool 10 carries the debris to the wellhead. The fluid jets 25 also have a second purpose. The fluid jets 25 since arranged about the middle of the second half of the tool 10, pushes the plurality of casing abrasion cleaning members 40A and 40B along the length of the central body section 13 toward the casing wall 1 so that direct contact is made. When, the fluid jets 25 are turned off, the tool 10 is allowed to resiliently, like a spring, and automatically move toward the center of the wellbore. The circle 2, shown in phantom, is axially displaced from the casing wall 1. The circle 2 represents the outer circumferential limits of the tool 10 measured from the distal ends of bristles 44. The jets 25 displace the tool 10 to offset the circle 2. When the jets 25 are off, the axis of circle 2 would align with the center axis of the casing wall 1.

More specifically, the fluid jets 25 serve as a controllable spring-biasing force (hereinafter, referred to as a "jet-biasing effect"). The jet-biasing effect is resilient by virtue of the fluidity of the fluid jet stream jetting from the fluid jets 25. This resiliency also allows the tool 10 to readily adapt to varying diameters of the casing wall 1. The jet-biasing effect when removed, allows the tool 10 to automatically retract to the central position in the wellbore.

In use, the tool 10 is preferably rotated in the wellbore by a fluid motor above the tool 10. Hence, the jet-biasing effect rotates as the tool 10 rotates so that the plurality of casing abrasion cleaning members 40A and 40B are biased to contact the casing wall 1. The jet-biasing effect is controlled by the number and size of the fluid jets 25, fluid volume and pressure.

Referring again to FIG. 1, the tool 10 is shown with a plurality of pairs of casing abrasion cleaning members 40A and 40B which are brushes. Nevertheless, the tool 10 may alternate each pair. One pair may be brushes with an adjacent pair made of scrapers or blades. On the other hand, a scraper or blade may be positioned between adjacent pairs of brushes. The brushes may also be pitched.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A tool comprising:

a plurality of casing abrasion cleaning members operable to apply a force of abrasion to a wellbore casing wall;

fluid jets operable and arranged to provide a force of fluid and, simultaneously, bias the plurality of casing abrasion cleaning members toward the casing wall; and, a tool body assembly having a first side and a second side, the first side has attached thereto the plurality of casing abrasion cleaning members which radiate from the first side and the second side has attached thereto the fluid jets wherein the first side and the second side are opposite sides, the plurality of casing abrasion cleaning members are arranged in a plurality of pairs of casing abrasion cleaning members longitudinally along the first side, each casing abrasion cleaning member of a pair is separated by approximately 120°, and a fluid jet is separated approximately 120° from said each casing abrasion cleaning member of the pair.

2. The tool in accordance with claim 1, wherein each casing abrasion cleaning member is a brush.

3. The tool in accordance with claim 1, wherein the first side and the second side are semi-circular.

4. The tool in accordance with claim 1, wherein the tool body assembly is adapted to be rotated in a wellbore.

5. The tool in accordance with claim 4, wherein the fluid jets provide a resilient jet-biasing effect on the tool body assembly to force the plurality of casing abrasion cleaning members toward the casing wall as the tool body assembly is rotated.

6. The tool in accordance with claim 5, wherein the resilient jet-biasing effect automatically biases the plurality of casing abrasion cleaning members toward the casing wall of varying diameters.

7. The tool in accordance with claim 5, wherein the resilient jet-biasing effect is adapted to be selectively turned on and off downhole in the wellbore.

8. The tool in accordance with claim 1, wherein the tool body assembly comprises a tool body base having a plurality of pairs of slots, each slot receives a base of a respective one casing abrasion cleaning member; an orifice positioned approximately an equal distance from said each slot of a respective one pair of slots; and a plurality of clamping sleeves adapted to be juxtaposed to clamp and lock the base of said respective one casing abrasion cleaning member.

9. The tool in accordance with claim 8, wherein each clamping sleeve comprises a ring-shaped structure having a convex half hole on the second side for forming a respective one fluid jet when any two adjacent clamping sleeves are juxtaposed; a top pair of concaved half holes on the first side opposite the second side; and a bottom pair of convex half holes on the first side wherein two adjacent clamping sleeves clamp and lock a pair of casing abrasion cleaning members.

10. The tool in accordance with claim 1, wherein the fluid jets are spaced apart longitudinally in series along a center of the second side.

11. The tool in accordance with claim 10, wherein each casing abrasion cleaning member of each pair of casing abrasion cleaning members is angularly displaced from an adjacent casing abrasion cleaning member of the pair.

12. The tool in accordance with claim 1, wherein the force of abrasion causes at least one of brushing, scraping, sweeping, or wiping.

13. A tool comprising:

means for cleaning a casing wall of a wellbore with a force of abrasion;

means for jetting fluid and, simultaneously, biasing the cleaning means toward the casing wall; and, means for supporting the cleaning means longitudinally along a first side thereof and forming the fluid jetting means longitudinally along a second side thereof wherein the first side and the second side are opposite sides;

wherein the cleaning means includes a plurality of sets of brushes, each set of brushes is displaced longitudinally along the first side from an adjacent set of brushes; and wherein each set of brushes comprises a pair of brushes separated by approximately 120°; and the jetting means comprises a fluid jet separated approximately 120° from each brush of the pair of brushes.

14. The tool in accordance with claim 13, wherein the first side and the second side are semi-circular.

15. The tool in accordance with claim 13, wherein the supporting means is adapted to be rotated in the wellbore.

16. The tool in accordance with claim 13, wherein the fluid jetting means comprises a plurality of fluid jets which provide a resilient jet-biasing effect on the supporting means to force the plurality of sets of brushes toward the casing wall as the supporting means is rotated.

17. The tool in accordance with claim 16, wherein the resilient jet-biasing effect automatically biases the plurality of sets of brushes toward the casing wall of varying diameters.

18. The tool in accordance with claim 16, wherein the resilient jet-biasing effect is adapted to be selectively turned on and off downhole in the wellbore.

19. The tool in accordance with claim 13, wherein the supporting means comprises a tool body base having a plurality of pairs of slots where each slot receives a base of a respective one brush of the pair of brushes, an orifice positioned approximately an equal distance from said each slot of a respective one pair of slots; and a plurality of clamping sleeves adapted to be juxtaposed to clamp and lock the base.

20. The tool in accordance with claim 19, wherein each clamping sleeve comprises a ring-shaped structure having a convex half hole on the second side for forming a respective one fluid jet; a top pair of concaved half holes on the first side opposite the second side; and a bottom pair of convex half holes on the first side wherein two adjacent clamping sleeves clamp and lock a pair of brushes.

21. The tool in accordance with claim 13, wherein the fluid jetting means comprises fluid jets spaced apart longitudinally in series along a center of the second side.

22. The tool in accordance with claim 13, wherein the force of abrasion causes at least one of brushing, scraping, sweeping, or wiping.

23. A method comprising the steps of:

applying a force of abrasion to a wellbore casing wall by a cleaning tool, wherein the applying step comprises the method steps of: brushing, scraping, sweeping or wiping the casing wall to remove debris at a first location; and, brushing, scraping, sweeping or wiping the casing wall to remove the debris at a second location wherein the second location is offset from the first location;

jetting fluid from the cleaning tool in the wellbore casing wall to create fluid jets and simultaneously applying a resilient jet-biasing force via the fluid jets to bias the force of abrasion to one side of the casing wall, wherein the jetting step comprises the step of jetting fluid at a third location which is displaced from the first and second locations and the offset is approximately 120°;

rotating the cleaning tool and the force of abrasion;

simultaneously rotating the resilient jet-biasing force and the fluid jets; and turning off the jet-biasing force downhole; and simultaneously with the turning off step, orienting the cleaning tool in a center of the casing wall.

24. The method of claim 23, wherein the first location is angularly displaced from the second location.

25. A tool comprising:

a plurality of casing abrasion cleaning members operable to apply a force of abrasion to a wellbore casing wall;

fluid jets operable and arranged to provide a force of fluid and, simultaneously, bias the plurality of casing abrasion cleaning members toward the casing wall; and, a tool body assembly having a first side and a second side, the first side has attached thereto the plurality of casing abrasion cleaning members which radiate from the first side, and the second side has attached thereto the fluid jets wherein the first side and the second side are opposite sides wherein the tool body assembly comprises a tool body base having a plurality of pairs of slots, each slot receives a base of a respective one casing abrasion cleaning member; an orifice positioned approximately an equal distance from said each slot of a respective one pair of slots; and a plurality of clamping sleeves adapted to be juxtaposed to clamp and lock the base of said respective one casing abrasion cleaning member.

26. The tool in accordance with claim 25, wherein each clamping sleeve comprises a ring-shaped structure having a convex half hole on the second side for forming a respective one fluid jet when any two adjacent clamping sleeves are juxtaposed; a top pair of concaved half holes on the first side opposite the second side; and a bottom pair of convex half holes on the first side wherein two adjacent clamping sleeves clamp and lock a pair of casing abrasion cleaning members.

27. The tool in accordance with claim 25, wherein the fluid jets provide a resilient jet-biasing effect on the tool body assembly to force the plurality of casing abrasion cleaning members toward the casing wall as the tool body assembly is rotated.

28. A tool comprising:

a plurality of casing abrasion cleaning members operable to apply a force of abrasion to a wellbore casing wall;

fluid jets operable and arranged to provide a force of fluid and, simultaneously, bias the plurality of casing abrasion cleaning members toward the casing wall; and, a tool body assembly having a first side and a second side, the first side has attached thereto the plurality of casing abrasion cleaning members which radiate from the first side, and the second side has attached thereto the fluid jets wherein the first side and the second side are opposite sides, the plurality of casing abrasion cleaning members are arranged in a plurality of sets of casing abrasion cleaning members which are spaced longitudinally along the first side, and the fluid jets are spaced apart longitudinally in series along a center of the second side.

29. The tool in accordance with claim 28, wherein each casing abrasion cleaning member of each set of casing abrasion cleaning members is angularly displaced from an adjacent casing abrasion cleaning member of the set.

30. A tool comprising:

means for cleaning a casing wall of a wellbore with a force of abrasion;

means for jetting fluid and, simultaneously, biasing the cleaning means toward the casing wall; and, means for supporting the cleaning means longitudinally along a first side thereof and forming the fluid jetting means longitudinally along a second side thereof wherein the first side and the second side are opposite sides wherein the cleaning means includes a plurality of sets of brushes, each set of brushes is displaced longitudinally along the first side from an adjacent set of brushes and said each set of brushes includes a pair of brushes and wherein the supporting means comprises a tool body base having a plurality of pairs of slots, each slot receives a base of a respective one brush of the pair of brushes, an orifice positioned approximately an equal distance from said each slot of a respective one pair of slots; and a plurality of clamping sleeves adapted to be juxtaposed to clamp and lock the base.

31. The tool in accordance with claim 30, wherein each clamping sleeve comprises a ring-shaped structure having a convex half hole on the second side for forming a respective one fluid jet; a top pair of concaved half holes on the first side opposite the second side; and a bottom pair of convex half holes on the first side wherein two adjacent clamping sleeves clamp and lock a pair of brushes.

32. A method comprising the steps of:

applying a force of abrasion to a wellbore casing wall by a cleaning tool, wherein the applying step comprises the method steps of: brushing, scraping, sweeping or wiping the casing wall to remove debris at a first location; and, brushing, scraping, sweeping or wiping the casing wall to remove the debris at a second location wherein the second location is offset from the first location;

jetting fluid from the cleaning tool in the wellbore casing wall to create fluid jets and simultaneously applying a resilient jet-biasing force via the fluid jets to bias the force of abrasion to one side of the casing wall, wherein the jetting step comprises the step of jetting fluid at a third location which is displaced from the first and second locations wherein the first location, second location and third location are angularly displaced by equal amounts;

rotating the cleaning tool and the force of abrasion;

simultaneously rotating the resilient jet-biasing force and the fluid jets;

turning off the jet-biasing force downhole; and simultaneously with the turning off step, orienting the cleaning tool in a center of the casing wall.

* * * * *